US005955007A

United States Patent [19]

Koizumi et al.

[11] Patent Number: 5,955,007

[45] Date of Patent: Sep. 21, 1999

[54] CARBURETOR FUEL ADJUSTING DEVICE

[75] Inventors: Kimio Koizumi, Isehara; Yasuaki Kohira, Sagemihara; Satoru Araki, Ebina, all of Japan

[73] Assignee: U.S.A. Zama Inc., Franklin, Tenn.

[21] Appl. No.: 08/915,358

[22] Filed: Aug. 20, 1997

Related U.S. Application Data

[63] Continuation of application No. 08/624,757, Mar. 27, 1996, Pat. No. 5,772,927, which is a continuation of application No. 08/526,039, Sep. 8, 1995, abandoned, which is a continuation-in-part of application No. 08/406,567, Mar. 20, 1995, Pat. No. 5,695,693.

[30] Foreign Application Priority Data

Sep. 13, 1994 [JP] Japan ..... 6-244828
Dec. 1, 1994 [JP] Japan ..... 6-323568

[51] Int. Cl.[6] ..... F02M 3/10

[52] U.S. Cl. ..... 261/67; 137/382; 261/71; 261/DIG. 38; 261/DIG. 84

[58] Field of Search ..... 261/67, 71, DIG. 38, 261/DIG. 84; 137/382; 411/301, 412, 542

[56] References Cited

U.S. PATENT DOCUMENTS

| | | | |
|---|---|---|---|
| 1,072,492 | 9/1913 | Pierson | 261/DIG. 38 |
| 3,166,292 | 1/1965 | Forman | 261/DIG. 38 |
| 3,618,906 | 11/1971 | Charron | 261/71 X |
| 4,040,328 | 8/1977 | Muenchinger | 411/412 |
| 4,271,095 | 6/1981 | Maeda | 261/71 X |
| 4,283,353 | 8/1981 | Miller | 261/DIG. 38 |
| 4,333,891 | 6/1982 | Miller | 261/DIG. 84 |
| 4,336,208 | 6/1982 | Gerhardy | 261/DIG. 38 |
| 4,641,577 | 2/1987 | Sweeny | 411/412 |
| 5,055,238 | 10/1991 | Araki | 261/67 X |
| 5,236,634 | 8/1993 | Hammett et al. | 261/71 |
| 5,252,261 | 10/1993 | Gerhardy | 261/71 |
| 5,294,227 | 3/1994 | Forster et al. | 411/412 |
| 5,322,645 | 6/1994 | Hammett et al. | 261/DIG. 38 |
| 5,525,267 | 6/1996 | Araki | 261/DIG. 38 |
| 5,695,693 | 12/1997 | Koizumi et al. | 261/71 |
| 5,772,927 | 6/1998 | Koizumi et al. | 261/67 |

FOREIGN PATENT DOCUMENTS

| | | | |
|---|---|---|---|
| 2352955 | 12/1977 | France | 261/DIG. 38 |
| 2401803 | 9/1974 | Germany | 261/DIG. 38 |
| 2548226 | 5/1976 | Germany | 261/DIG. 38 |
| 47-42424 | 10/1972 | Japan | 261/DIG. 84 |
| 00-14234 | 2/1978 | Japan | 261/DIG. 84 |
| 61-134555 | 8/1986 | Japan . | |
| 1-28220 | 6/1989 | Japan . | |

OTHER PUBLICATIONS

References Cited In Either One of Parent Cases SNS 08/624757 or 08/406,567.

*Primary Examiner*—Richard L. Chiesa
*Attorney, Agent, or Firm*—Lyon & Lyon

[57] ABSTRACT

In a first aspect, a carburetor fuel adjusting device that facilitates control of the quantity of fuel that flows from the fuel chamber to an air intake port of a carburetor by making it possible for the user to adjust an adjustment valve within the limits defined by emission control regulations. The carburetor fuel adjusting device has a cap having two appendages, and an engagement area to engage a valve extension of the fuel adjustment valves of a carburetor. The cap is retained by the retainer in either a disengaged position, or an engaged position wherein the engagement area of the cap becomes attached to the valve extensions. In the engaged position, the adjustment valves can be turned in unison with the cap within a range formed by the angle between the appendages which, when rotated, abut against stoppers. In a second aspect, a retaining plate of elastic material having two retainer holes adapted to receive and retain the pair of adjustment valves in a prescribed adjustment position is laid against an outer surface of the carburetor body. The adjustment valves each have a base-end portion and a small diameter portion, the threads of the base-end portion having an external diameter larger than that of the threads of the small diameter portion. The external diameter of the threads of the base-end portion is also larger than the diameter of each of the retainer holes of the retaining plate such that when the adjustment valve is screwed into the screw hole of the carburetor, the base-end portion cuts threads in the retainer holes of the retaining plate to thereby prevent rotation of the adjustment valve.

11 Claims, 5 Drawing Sheets

CARBURETOR FUEL ADJUSTING DEVICE

This is a continuation of application Ser. No. 08/624,757, filed on Mar. 27, 1996, now U.S. Pat. No. 5,772,927, which is a continuation of application Ser. No. 08/526,039, filed Sep. 8, 1995, now abandoned, which is a continuation-in-part of application Ser. No. 08/406,567, filed Mar. 20, 1995, now U.S. Pat. No. 5,695,693 and which are incorporated herein by reference.

FIELD OF THE INVENTION

This invention relates to carburetors designed to supply fuel to multi-purpose engines that power agricultural equipment, gardening equipment, and small vehicles and, more particularly, devices for the manual adjustment of fuel flow quantity for such carburetors.

BACKGROUND

Carburetors for multi-purpose engines supply a considerably lower quantity of fuel to the engine in comparison with carburetors that supply fuel to four-stroke engines, such as automobile engines. Significant changes in fuel mixture ratio result from inaccuracies in carburetor component placement and dimension. Differences in engine performance must also be taken into consideration. All of these factors make it necessary to be able to adjust carburetor fuel flow quantity separately for each individual engine.

Given this necessity, a manually adjustable fuel valve is included in the design of some carburetors. Such valves comprise a needle-shaped, tapered valve that remains inserted into the fuel jet and is mounted on the end of a threaded rod that has an extension at the opposite end. The extension protrudes from the carburetor body into which the threaded rod is screwed. By twisting the extension, the needle valve can be moved back and forth within the carburetor body, thus changing the effective cross-sectional area of the jet. This adjusts the quantity of fuel flow through the jet. Both the main fuel jet and the low-speed fuel jet can be equipped with such valves, thus making it possible to adjust fuel flow quantity separately for each jet. In order to obtain the appropriate quantity of fuel flow, these valves are normally adjusted by the manufacturers of the carburetors and engines, and by the manufacturers of the vehicles or the appliances in which the carburetors are used. However, in certain situations, the user of the engine will make adjustments in an attempt to maintain performance in different locations and under different operating conditions or to improve performance in cases of temporary loss of engine performance. As a result, an excessively rich or excessively lean fuel and air mixture is created, often resulting in less engine power, worsening of the quality of the exhaust, engine stalling, and other engine troubles.

An additional issue to consider is that regulations governing the emissions of multi-purpose engines, which have been put into effect in recent years, make it necessary to equip these engines with a limiting device that allows the user to make adjustments, after the manufacturer has adjusted the carburetor valves, substantially only within the range allowed by law. These devices must also be constructed such that they are difficult to remove from the carburetors.

Devices to limit the adjustment of the fuel adjustment valve have been described in the art. U.S. Pat. No. 3,618,906 describes a cap that has been installed on the end of the adjustment valve. The cap is equipped with a radially protruding appendage that limits adjustment to within one revolution because the appendage is obstructed by the carburetor body acting as a stopper. U.S. Pat. No. 5,236,634 describes valves for both the main fuel jet and the low-speed fuel jet as being placed parallel and adjacent to each other and having a cap with an appendage being obstructed by the other adjustment valve, or its extension acting as a stopper.

However, both of these valve adjustment limitation devices protrude from the carburetor body. Their exposure makes it easier for the user to remove them with a bit of ingenuity. Thus, these devices do not prevent deliberate and resolute tampering by the user.

Other shortcomings with these designs exist during the manufacturing process. Either the valves have to be assembled provisionally so as not to slip out prior to adjustment and, after adjustment of the valves, the cap is installed permanently in a position where its appendage is in contact with the stopper, or the valves are installed only after adjustment with the appendage of the cap in a position in contact with the stopper, without provisional assembly. Not only is it difficult to assemble the very small parts one by one, by hand, but in some cases the appendages are not positioned correctly in relation to their stoppers. This results in some carburetors having a wider adjustable range in one direction, which could possibly produce an excessively rich or excessively lean mixture and make it substantially possible to operate outside the legal limit for emissions.

Therefore, it would be desirable to have a limiting device for a carburetor, having manually adjustable valves placed parallel and adjacent to each other and that are able to adjust the effective cross-sectional area of the main and low-speed fuel jets separately, being capable of preventing deliberate and resolute tampering by the user, eliminating the difficulty in handling small parts, and preventing the emissions, when the engine is being used in a normal manner, from exceeding the legal limitations due to an inaccurate setting made by the manufacturer.

A still further issue to consider relates to the manner in which adjustment valves of the prior art are fixed in a prescribed adjustment position. Ordinarily, a compression coil spring is mounted around the threaded rod between the main body of the carburetor and the head portion in order to fix the adjustment valve in a prescribed adjustment position. However, since there is a slight gap between the female threads formed in the screw hole of the main body of the carburetor and the male threads formed on the threaded rod, the following problem arises: when the threaded rod is screwed into the prescribed adjustment position while being pressed with a screwdriver which is engaged with the head portion, and the screwdriver is then released, the compression spring causes the adjustment valve to return in the axial direction by an amount corresponding to the gap between the aforementioned male and female threads. As a result, the flow rate is thrown out of adjustment, which may have a serious effect on the air/fuel ratio, especially in the carburetor of a multi-purpose engine. Furthermore, since the adjustment valve is arranged so that rotation of the valve is prevented by contact friction between the compression spring and the head portion of the threaded rod, it is necessary to use a fairly long spring, and to cause the spring to contact the head portion with a strong force in order to prevent rotation of the adjustment valve. As a result, the threaded rod and head portion protrudes by a considerable amount from the main body of the carburetor. In cases where the carburetor is enclosed in a housing and attached to a multi-purpose engine, the size of the housing must therefore be increased. Furthermore, since the protruding parts are long, the rotational moment generated as a result of vibration of the engine or vibration of the machine or vehicle, etc., is large, so that the adjustment valve may rotate, thus causing the air/fuel ratio to be thrown out of adjustment.

Furthermore, it has been suggested to use two adjustment valves in a carburetor for a multi-purpose engine, i.e., one for the main fuel feed and one for the low-speed fuel feed. (See, for example, Japanese Utility Model Application Kokai No. Sho 61-134555.) In such a circumstance, the two adjustment valves are installed parallel to each other and in close proximity to each other. As a result, there may be contact interference between the respective compression springs, so that the rotation-stopping function is lost.

To address this problem, Japanese Patent Application Kokoku No. Hei 1-28220 proposes an arrangement in which a square retaining plate made of an elastic synthetic resin is used to prevent rotation instead of the compression coil spring. The retaining plate is provided with a hole having a diameter slightly smaller than that of the threaded rod, and the threaded rod passes through the hole while cutting threads in the edge of the hole as it is screwed into the screw hole in the main body of the carburetor. Specifically, a thin square recess is formed in the main body of the carburetor, overlapping the screw hole of the main body, and the square retaining plate is inserted into this recess. The threaded rod passes through the retaining plate while being screwed into the carburetor screw hole. Since the threads of the threaded rod are engaged with the threads cut in the edge of the hole of the retaining plate, both rotational movement and back-and-forth movement in the axial direction of the threaded rod are prevented by the back surface and edge surfaces of the retaining plate contacting the facing inside surfaces of the recess. In this structure, a recess for inserting the synthetic resin plate must be formed in the main body of the carburetor, requiring extra steps in the manufacture of the carburetor. In addition, the retaining plate must be inserted into the recess so that the hole in the retaining plate is concentric with the screw hole. As a result, such a technique presents a number of disadvantages.

Therefore, it would be desirable to have an easy to assemble fuel adjusting device for a carburetor, having manually adjustable valves placed parallel and adjacent to each other and that are able to adjust the effective cross-sectional area of the main and low-speed fuel jets separately, being capable of preventing rotation of the adjustment valves, and eliminating the problems of return of the adjustment valves after adjustment of the valves with a screwdriver.

SUMMARY OF THE INVENTION

A primary objective of the present invention is to provide a fuel adjusting device that comprises limiting caps that are engaged with the extensions of fuel adjustment valves and possess radially protruding appendages whose rotation is obstructed by stoppers, that prevents tampering by the user, that is easy to handle, and that allows the user to make adjustments only within the limits of the emission regulations. A further objective of the present invention is to provide an easy-to-assemble fuel adjusting device with a simple structure in which a plate made of an elastic material functions, in place of compression coil springs, to prevent rotation of the adjustment valves.

In a first, separate exemplary embodiment of the present invention, the components are easier to handle and the possibility of deliberate tampering by the user is reduced because the caps are pressed into a retainer that is fixed onto the carburetor body. In addition, the appendage and stopper construction along with the predetermination of the respective retaining positions of the caps within the retainer, enable the user to make adjustments substantially only within a range of allowable emissions.

In order to achieve such objectives, the limiter caps of the present invention have insertion holes for a tool to pass through to adjust the valve. At the end of the insertion holes, there are engagement areas where the caps become attached to the valves. Once engaged, the cap and valve act as one unit, moving together when turned. At the base ends of each cap, there are primary and secondary appendages, that protrude radially from positions predetermined by necessary phasing, and that separately limit turning in both the direction that creates a richer mixture and the direction that creates a leaner mixture.

The retainer that is attached to the carburetor body allows room for the caps to remain in a position in retention holes disengaged from the extensions of the adjustment valves. It is preferable that it not be possible for the caps to turn while in this disengaged position, but that the caps be able to move forward to engage the extensions of the adjustment valves.

In cases where only one cap is engaged onto the main fuel jet valve, the extension of the low-speed fuel jet valve, or a protrusion included in the structure of the retainer, becomes the stopper. The construction of the device is such that the stopper is located between the two appendages of the cap.

However, where caps are to be installed on both valves, each cap becomes a stopper for the other. The construction of the device being such that each cap is located between the two appendages of the opposite cap.

Furthermore, it is preferable to prevent the cap in the disengaged position from slipping out of the retention hole by installing a protrusion on the cap that prevents this, and by creating a cylindrical cut-out, having a smaller cross-section than that of the cap, to be used as the retention hole.

In addition, the cap preferably cannot be turned when in the disengaged position, but it is preferable that it be able to turn when inserted forward into the retention hole into the engaged position. When the cap is inserted through the retention hole, it is in a preferred position, such that the secondary appendage almost touches its stopper enabling the user to adjust substantially only in the leaner mixture direction.

Further, when two caps are employed, it is preferable that both the caps are of the same dimensions, are positioned such that they are at a 180 degree angle to each other in the disengaged position, and cannot be turned when inserted into the retention hole to be retained in the disengaged position.

The manufacturer adjusts the effective cross-sectional area of the fuel jet to a predetermined fuel flow quantity by adjusting the valve. This is accomplished by inserting a tool through the insertion hole of the cap while it is in the disengaged position in the retention hole. Next, the cap is pressed forward, engaging the cap with the end of the adjustment valve. From this point on, the cap and valve become securely attached to each other and move in unison, thus allowing the user to make adjustments substantially only within the range defined by the opening between the appendages. The cap is also held within the retainer hole of the retainer and is not completely exposed, thus making it more difficult to be removed.

In a second, separate exemplary embodiment of the present invention, several of the aforementioned problems of the prior art fuel adjusting devices are resolved by using a retaining plate made of an elastic material, instead of compression springs, to stop the rotation of the adjustment valves used to adjust the air/fuel ratio. To date, there has been no easy-to-assemble device with a simple structure which utilizes a retaining plate positioned on the outer surface of the carburetor main body, in a manner similar to a conventional compression spring, and passing the adjustment valves through the retaining plate in a screw-engaged state.

The fuel adjusting device is provided with adjustment valves each comprising a needle valve which adjusts the effective area of a fuel passage or air passage by being adjustably inserted into the fuel passage or air passage, and a threaded rod which is inserted into a screw hole formed in the main body of the carburetor so that the base end of the threaded rod protrudes from the screw hole. The fuel adjusting device further comprises a retaining plate made of an elastic material and which has a pair of retainer holes formed therein that are slightly smaller in diameter than the base-end portions of the threaded rods. The retaining plate is constructed so that the threaded rods pass through the retainer holes in the retaining plate such that the base-end portions of the threaded rods cut threads in the edge of the retainer holes as the threaded rods are screwed into the screw holes in the main body of the carburetor. Annular projecting strips are formed on the surface of the retaining plate surrounding the retainer holes in the retaining plate.

The threaded rods of the adjustment valves are each provided with a threaded small-diameter portion and a threaded base-end portion. The pitch, thread-bottom diameter and effective diameter of the threads on the small-diameter portion of each threaded rod are equal to those of threads on the base-end portions of the threaded rods, but the external diameter of the threads of the small-diameter portion is smaller than the external diameter of the threads on the base-end portions of each threaded rod. The retainer holes in the retaining plate are formed so that each has a diameter which is smaller than the external diameter of the base-end portions of the threaded rods, but larger than the external diameter of the small-diameter portions of the threaded rods. The threaded rods pass through the retainer holes in the retaining plate and screw into the screw holes formed in the main body of the carburetor. The female threads of the screw holes are formed with a pitch, thread-bottom diameter, effective diameter and internal diameter that match the male threads formed on the base-end portions of the threaded rods.

To assemble the fuel adjusting device, the retainer holes of the retaining plate are aligned with the screw holes in the main body of the carburetor, and the retaining plate is laid against the outer surface of the main body such that the annular projecting strips engage the outer surface of the main body. The adjustment valve is then inserted into the screw hole, passing through the hole formed in the retaining plate. During this process, the needle valve and small-diameter portion of the threaded rod pass unobstructedly through the retainer hole in the retaining plate, and the base-end portion of the threaded rod reaches the hole in the retaining plate only after the threads of the small-diameter portion of the threaded rod are engaged with the threads of the screw hole. The base-end portion of the threaded rod then passes through the retainer hole in the retaining plate while cutting threads in the edge of the hole, and is then screwed into the screw hole. In other words, the biting of the threaded rod into the edge of the retainer hole in the retaining plate is initiated while the threaded rod is maintained on a straight line as a result of the small-diameter portion of the threaded rod being screwed into the screw hole formed in the main body of the carburetor. Accordingly, the threaded rod passes through the retainer hole in the retaining plate, while cutting threads in the edge of the hole, without any side-to-side inclination of the threaded rod with respect to the retaining plate. As a result, an object of the present invention, i.e., to provide an easy-to-assemble fuel adjusting device with a simple structure, is achieved.

In a third, separate exemplary embodiment of the present invention, a fuel adjusting device comprises the retainer and limiter caps substantially as described above, but in which a retaining plate is formed integrally with the retainer. The fuel adjusting device is provided with adjustment valves each comprising a needle valve which adjusts the effective area of a fuel passage or air passage, and a threaded rod which is inserted into a screw hole formed in the main body of the carburetor so that the base end of the threaded rod protrudes from the hold. The threaded rods of the adjustment valves are each provided with a threaded small-diameter portion and a threaded base-end portion. By combining the retainer with the retaining plate, the fuel adjusting device achieves all of the advantages described above.

DETAILED DESCRIPTION OF THE PREFERRED EMBODIMENTS

Figure 1:
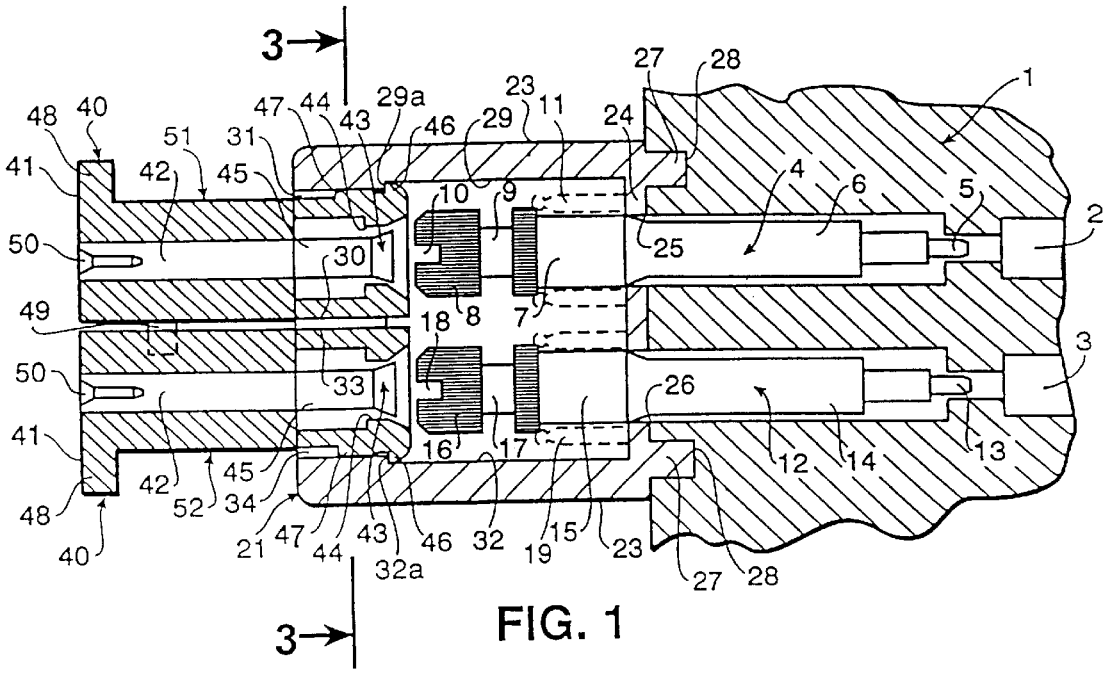
FIG. 1 is a cross-sectional view of an embodiment of the present invention in a disengaged position.

Referring now in detail to the drawings, there is illustrated a novel carburetor fuel adjusting device for a general purpose engine carburetor according to the present invention. Turning to FIGS. 1 to 5 to describe an embodiment of present invention, fuel flows from a diaphragm or float chamber, not shown, through an intake passage, also not shown, that leads to a main fuel jet 2 and a low-speed fuel jet 3, and on through to a main nozzle, an idling port, and a slow port, also not shown. The effective areas of the main and low-speed fuel jets 2 and 3 are adjusted separately by manual adjustment valves 4 and 12, which are placed parallel and adjacent to each other.

The adjustment valves 4 and 12 comprise tapered needle valves 5 and 13 inserted into the fuel jets 2 and 3, threaded rods 6 and 14 screwed into a carburetor body 1, valve extensions 7 and 15 that protrude from the carburetor body 1. The valve extensions 7 and 15 are knurled at their ends in a straight pattern parallel to their longitudinal axis to create knurled heads 8 and 16 adjacent cap lock grooves 9 and 17 in the valve extensions 7 and 15. In addition, tool slots 10 and 18, which are used for making valve adjustments, are located in the end of the knurled heads 8 and 16.

A retainer 21, preferably made of hard plastic, is substantially box-shaped and comprises a bottom wall 22, side walls 23, and a contact wall 24. The contact wall 24 possesses two assembly protrusions 27 that fit hermetically into two assembly holes 28 in the carburetor body 1. Loosening prevention springs 11 and 19, which are inserted between valve extensions 7 and 15 and the contact wall 24, continually push the contact wall 24 onto to the carburetor 1, fixing the retainer 21 onto the carburetor 1.

Adjacent the contact wall 24 of the retainer 21 and the end of the carburetor body 1 are two cylindrical cut-outs 29 and 32 within the retainer 21. The extensions 7 and 15 of the adjustment valves 4 and 12 are located within the cutouts 29 and 32, with the adjustment valves 4 and 12 extending through extension holes 25 and 26 in the contact wall 24. Retention holes 30 and 33 are located within the retainer 21 adjacent the cutouts 29 and 32 and away from the contact wall 24. The retention holes 30 and 33 are connected at the sides by a passage 35*a*, that is located at the base of a split groove 35 which opens on the side of the retainer 21 opposite the bottom wall 22. The retention holes 30 and 33 are totally round, but are slightly smaller in diameter near the cylindrical cut-outs 29 and 32. Also, grooves 31 and 34 are cut along the length of retention holes 30 and 33 respectively, at positions located 180 degrees with respect to each other.

A cap 40 preferably is made of hard plastic. A tool used for the adjustment of the adjustment valves 4 and 12, usually a screwdriver, can be inserted into an insertion hole 42 in the cap 40. The insertion hole 42 is a cylinder with an engagement area 43 located at the end of the insertion hole 42 opposite a base end 41 of the cap 40. The engagement area 43 comprises grips 44 and two protruding areas 45 that are located reciprocally and at an angle of 90 degrees to each other. The engagement grips 44 fit into the cap lock grooves 9 and 17 of the extensions 7 and 15 of the adjustment valves 4 and 12, while the knurled heads 8 and 16 of the extensions 7 and 15 are enveloped by the protruding areas 45. The protruding areas 45 are of a slightly smaller diameter than the knurled heads 8 and 16 of the valve extensions 7 and 15.

Also, a detachment prevention lip 46 is formed on the outer surface of the rim of the end of the cap 40 and comes in contact with inner surfaces 29*a* and 32*a*, adjacent the split groove 35 and formed by the cylindrical cut-outs 29 and 32. A key 47 is similarly formed longitudinally along the outer surface of the end of the cap 40 and fits into grooves 31 and 34 in positions located 180 degrees in relation to each other.

In addition, installed on the outer surface of the base end 41 of the cap 40 are two wing-shaped appendages 48 and 49 that are out of phase with each other and staggered in relation to each other longitudinally along the axis of the cap 40. For example, a primary appendage 48 is located nearest the base end of the cap 40 and sweeps an angle from 0° to 90°, approximately, while a secondary appendage 49 is spaced away from the primary appendage 48 longitudinally along the axis of the cap 40 and sweeps an angle from 90° to 180°, approximately. The primary appendage 48 limits the turning of the valve in the lean direction, and the secondary appendage 49 limits turning in the rich direction.

When the caps 40 are pressed into the retention holes 30 and 33, the detachment prevention lips 46 are located in a position in contact with the inner surfaces 29*a* and 32*a* of cylindrical cut-outs 29 and 32 preventing the caps 40 from slipping out of the retainer 21 when in the disengaged position (see FIG. 1). At this time, because the diameter of the retention holes 30 and 33 is smaller in the area near the inner surfaces 29*a* and 32*a*, the caps 40 are squeezed and pressed upon, and because of the mutual action of the grooves 31 and 34 and keys 47, the caps 40 are retained and maintained in a state in which they cannot be turned.

By fixing the retainer 21 on the carburetor body 1 and configuring the retainer 21 to maintain the caps 40 at predetermined angles in relation to each other in the disengaged position, not only are the caps 40 easy to handle, but there is no need to worry about forgetting to install the caps 40. Once the caps 40 are installed, it is possible for the user to substantially only adjust the adjustment valves 4 and 12 within the range of emission regulation limitations.

While the caps 40 are in the disengaged position within the retainer 21, the manufacturer inserts a tool in the insertion hole 42 to engage the tool slots 10 and 18 in the end of knurled heads 8 and 16, and adjust, separately, the effective cross-sectional area of the two fuel jets 2 and 3 by adjusting adjustment valves 4 and 12. The adjustment to the valves 4 and 12 is made freely without the caps 40 interfering in any way. The carburetor, adjusted by its manufacturer, is then installed on an engine where the engine manufacturer can make further wide-range adjustments while measuring the CO concentration of the engine's emissions.

When the final adjustment has been completed, pressing hard on the base end 41 of the caps 40 will cause the caps 40 to slide forward because the keys 47 are in the grooves 31 and 34. In the engagement area 43 of the insertion hole 42 of the caps 40, the engagement grips 44 fit into the cap lock grooves 9 and 17, and, at the same time, protruding area 45 will envelop the knurled heads 8 and 16, thus engaging the valve extensions 7 and 15 such that the caps 40 can neither move longitudinally nor rotationally relative to the valve (see FIG. 5). At this point, the key 47 leaves the grooves 31 and 34, and the cap 40 becomes engaged and integrated with valves 4 and 12 so as to turn in unison with the valves 4 and 12.

Thus, the user receives the carburetor with caps 40 integrated and turning together with adjustment valves 4 and 12, that is to say, in a final stage of assembly. The user can insert tools through insertion holes 42 to engage the tool slots 10 and 18 in the end of knurled heads 8 and 6, or use a tool to engage engagement slots 50 in the base end 41 of the caps 40 to make further adjustments to the adjustment valves 4 and 12. These adjustments change the effective cross-sectional area of the fuel jets 2 and 3 while maintaining emissions within regulations.

Figure 2:
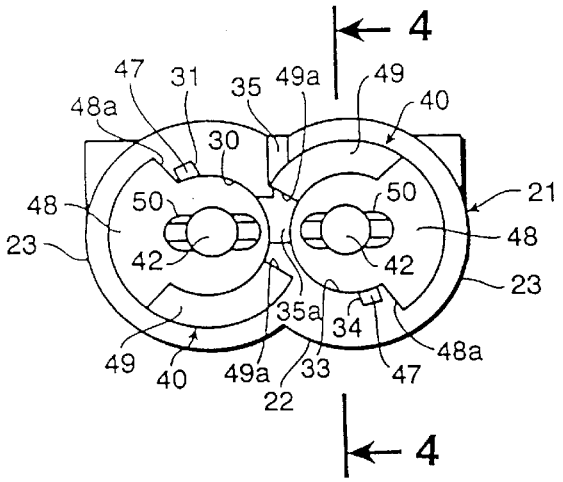
FIG. 2 is an end view viewed from the left side in FIG. 1 and rotated 90°.
Figure 3:
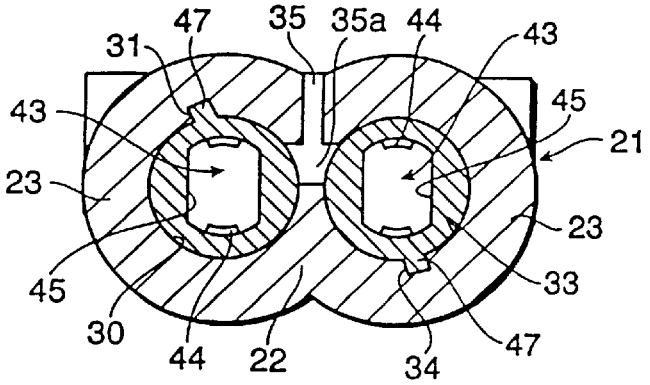
FIG. 3 is a cross-sectional view along a line 3—3 in FIG. 1 and rotated 90°.
Figure 4:
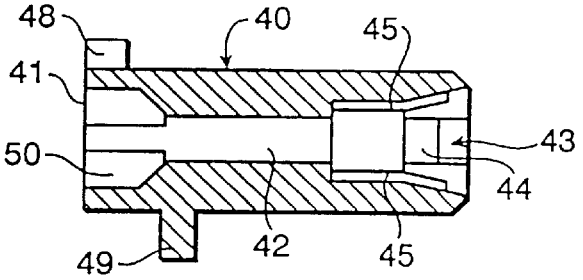
FIG. 4 is a cross-sectional view of a cap cut along a line 4—4 in FIG. 2.
Figure 5:
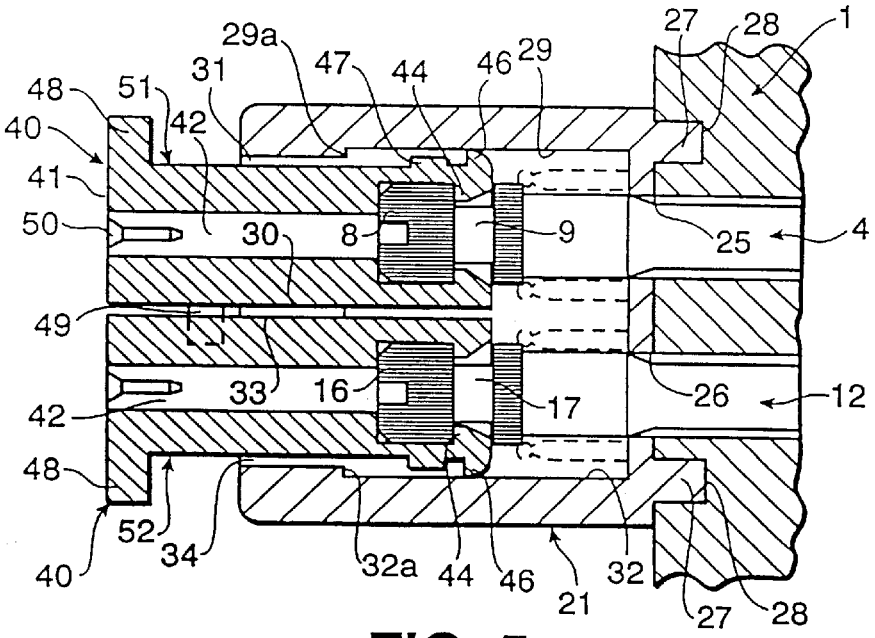
FIG. 5 is a cross-sectional view of an embodiment of the present invention in an engaged position.

As shown in FIG. 2, the caps 40 are inserted into the retention holes 30 and 33 in such a position that the edge 49*a* of the secondary appendage 49, which limits turning in the rich mixture direction for each of the two caps 40, is almost in contact with the outer surface of the other cap 40. As a result, when the caps 40 are pressed forward and engaged with extensions 7 and 15, it becomes extremely difficult, if not impossible, to make adjustments in the direction that increases the effective cross-sectional area of the fuel jets 2 and 3, the "rich" direction.

On the other hand, it is possible to turn in the direction that decreases the effective cross-sectional area of fuel jets 2 and 3, the "lean" direction, to a point where the edge 48*a* of the primary appendage 48 comes in contact with the other cap 40. Therefore, by setting the turning angle range for the appendage 48 appropriately, and having the partner caps 40 acting as stoppers 51 and 52 for each other, the adjustments in the lean mixture direction, which does not increase the concentration of CO in the engine's emissions, can be made within the range of emission regulations.

It is also possible to adjust the range of emissions in either the lean or the rich mixture direction by opening the angle between the edges 48*a* and 49*a* of appendages 48 and 49.

Since the tips of the caps 40 are surrounded in three directions by the bottom wall 22 and side walls 23 of the retainer 21, and the middle part is retained within the retention holes 30 and 33, the caps 40 are not easily detached without destroying the retainer 21. Thus, the embodiment of the present invention tends to prevent a user's deliberate and resolute tampering.

Figure 6:
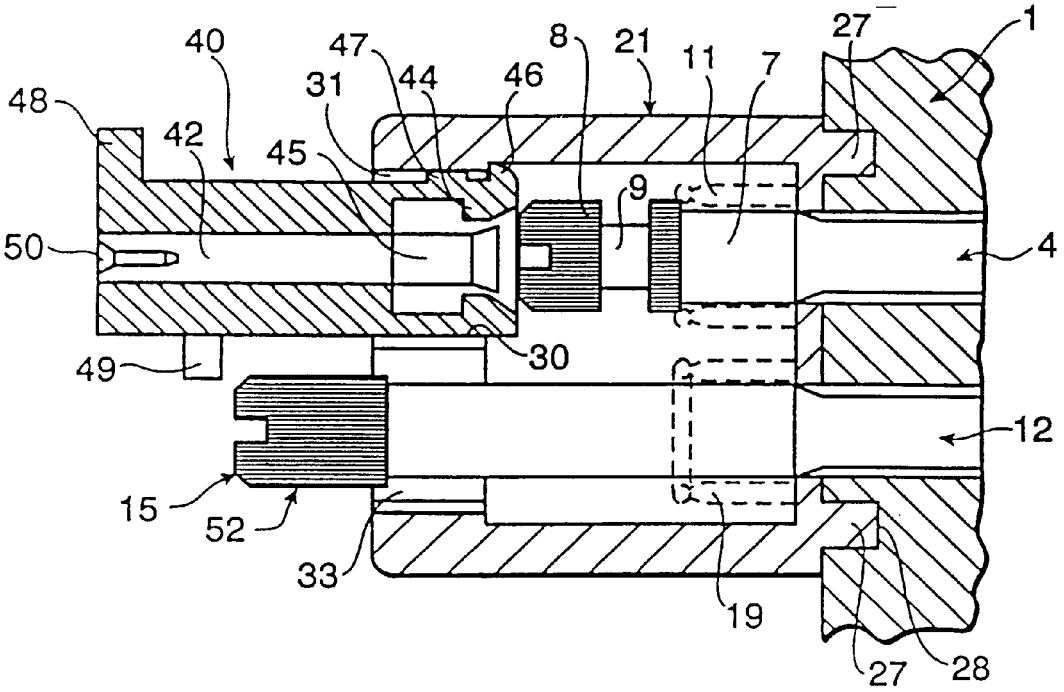
FIG. 6 is a cross-sectional view of an alternative embodiment of the present invention.

In the embodiment described above, the user is able to limitedly adjust both of the adjustment valves 4 and 12. Turning to FIG. 6, an alternative embodiment is shown in which the user can freely adjust the adjustment valve 12 of the low-speed fuel jet 3. The extension 15, of the adjustment valve 12, protrudes from the location of the retention hole 33 of the retainer 21 in the previous embodiment, while on the adjustment valve 4 of the main fuel jet 2 side of the retainer 21, the cap 40, described above, is arranged and inserted into the retention hole 30. As above, the angle between the two appendages 48 and 49 of the cap 40 determine the effective cross-sectional area of the main fuel jet 2. The adjustment valve 4 is rotated within the range of the fixed angle between the appendages 48 and 49 and is limited by using the extension 15 arranged between the appendages 48 and 49 as a stopper 52.

Figure 7:
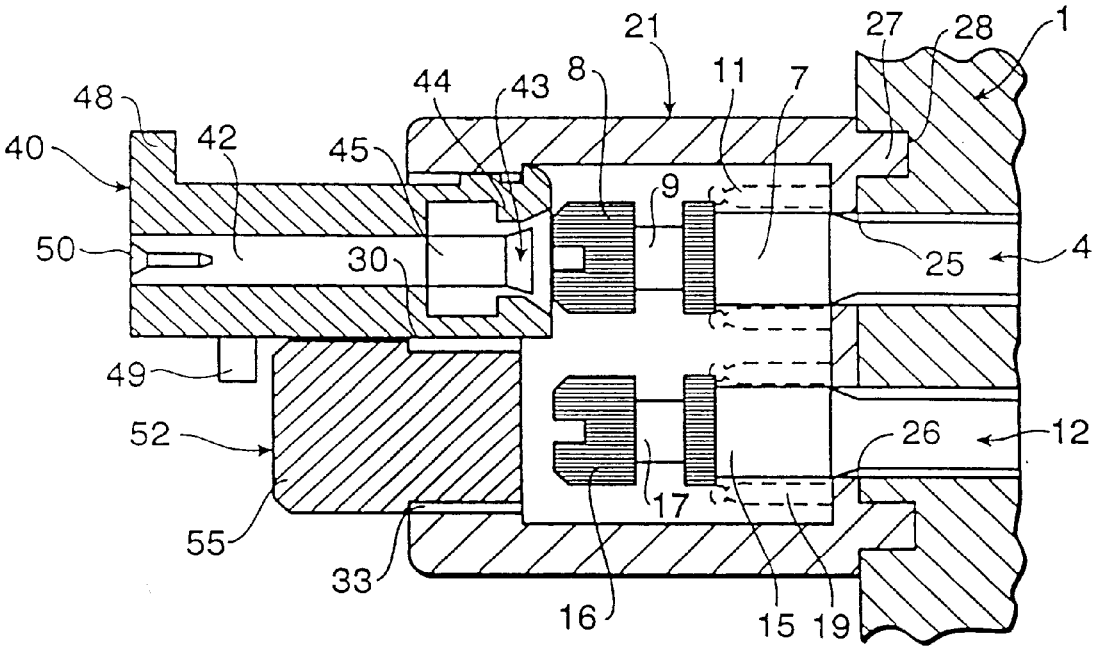
FIG. 7 is a cross-sectional view of another alternative embodiment of the present invention.

FIG. 7 shows another alternative embodiment wherein the user is not allowed to adjust the low-speed adjustment valve 12. A blank cap which comprises a protrusion 55 is attached to adjustment valve 12 in retention hole 33 of the retainer 21, making it substantially impossible to adjust the adjustment valve 12. The cap 40 of the previous embodiment is inserted in retention hole 30 and attached on the main fuel jet adjustment valve 4. The two appendages 48 and 49 of the cap 40 use the adjacent protrusion 55 as a stopper 52, and allow adjustment of the effective cross-sectional area of the main jet 2 by adjusting the adjustment valve 4 within a predetermined range defined by the angle between the appendages 48 and 49.

The embodiments illustrated and described in FIGS. 6 and 7 utilize the retainer 21 and the caps 40 of the embodiment illustrated and described in FIGS. 1 to 5 without substantial modification. Other variations of the embodiment of the present invention can be utilized on different types of carburetors, offering advantages in production and cost control.

Furthermore, it is possible to attach the retainer 21 to the carburetor body 1 with threads or by using adhesives. Other variations are also possible, such as enclosing adjustment valves 4 and 12 from all sides, using perfect cylinders for the retention holes 30 and 33 without cutting out any portion, or making the two appendages 48 and 49 into one integrated part.

In an additional embodiment (not shown), the cap 40 can be configured so that it freely turns in the disengaged position for adjustment during the manufacturing phase. Before handing the carburetor or engine over to the user, the two stoppers 51 and 52 can be adjusted in relation to the appendages 48 and 49. The cap 40 is, as above, pressed forward to engage the knurled head 8 and 16, thus limiting rotation of the valves 4 and 12 to follow emission regulations.

As should be clear from the above explanation, the cap 40 constitutes an adjustment valve 4 and 12 limiting system. By installing the cap 40 into the retainer 21 which is attached to the carburetor body 1, the small cap 40 becomes easy to handle, the concern about the possibility of forgetting to install the cap 40 diminishes, and the likelihood of deliberate and resolute tampering by the user is substantially deterred. Further, by setting the angle between the two appendages 48 and 49, which are installed on the cap 40 to limit turning in the lean mixture direction and in the rich mixture direction, and the relative angles of insertion in the retention holes 30 and 33 of the retainer 21 correctly, the user is substantially only able to adjust the adjustment valves 4 and 12 within the range of emission control regulations, using the protruding area 55 on the retainer 21 or the other cap 40 as stoppers 51 and 52. Therefore, with the carburetor fuel adjusting device of the present invention, the user can adjust the air-fuel mixture while limiting the risk of problems such as power decrease, worsening of the exhaust gas quality, or engine stoppage resulting from an overly lean or overly rich mixture.

Figure 8:
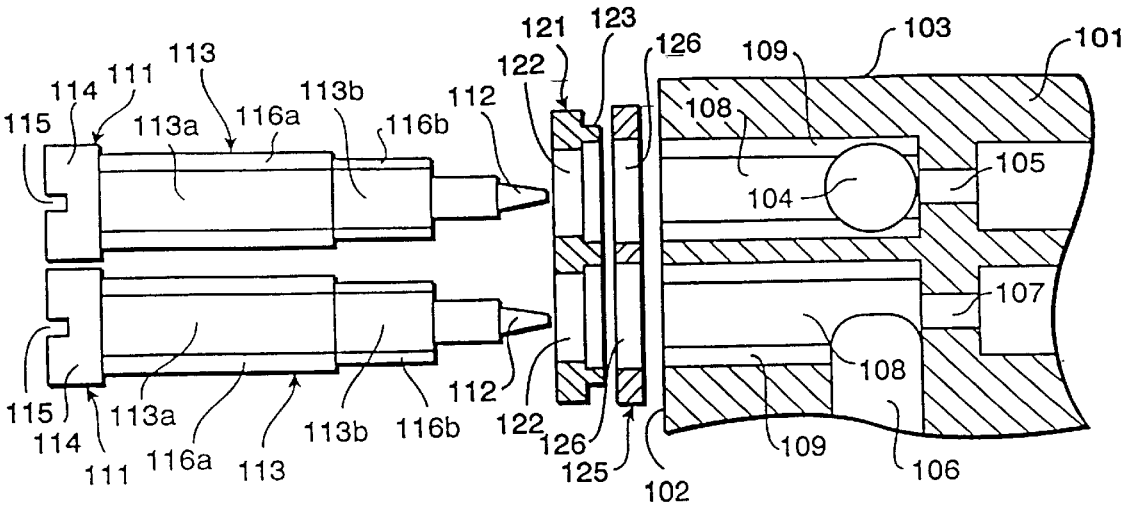
FIG. 8 is a cross-sectional exploded view of an alternate embodiment of a fuel adjusting device in accordance with a preferred form of the present invention.
Figure 9:
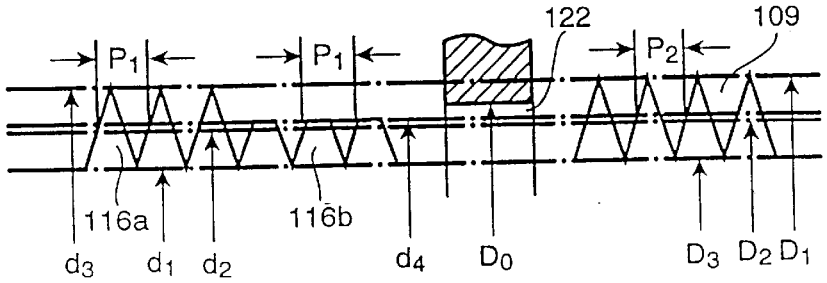
FIG. 9 is a diagram illustrating the dimensional relationships of the threaded rods of the adjustment valves, the holes in the retaining plate and the screw holes in the carburetor main body, in accordance with a preferred form of the present invention.
Figure 10:
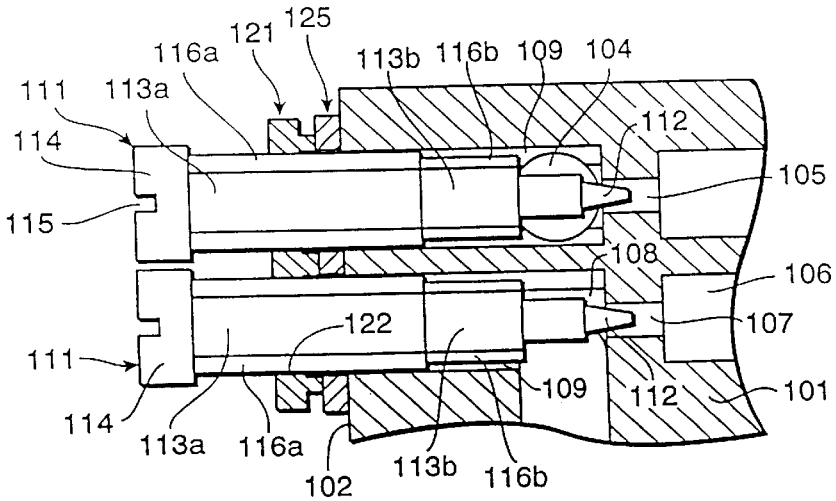
FIG. 10 is a cross-sectional view of the fuel adjusting device of FIG. 8, in assembled form.

Turning now to FIGS. 8 through 10, there is illustrated a fuel adjusting device adapted for use in conjunction with a carburetor for a multi-purpose engine having two adjustment valves, i.e., one for the main fuel feed and one for the low-speed fuel feed. In FIG. 8, fuel flows from a diaphragm or float chamber, not shown, through a main fuel passage 104 and a low-speed fuel passage 106, that lead to a main fuel jet 105 and a low-speed fuel jet 107, and on through to a main nozzle, an idling port, and a slow port, also not shown. The effective areas of the main and low-speed fuel jets 105 and 107 are adjusted separately by the two identical manual adjustment valves 111, which are placed parallel and adjacent to each other.

Each of the adjustment valves 111 comprises a tapered needle valve 112 inserted into one of the fuel jets 105 and 107, a threaded rod 113 screwed into one of two screw holes 108 in the carburetor body 101, and a head portion 114 that protrudes from the carburetor body 101. Each screw hole 108 extends from one outer surface 102 of the carburetor main body 101 to either the main jet 105 or the low-speed jet 107. The head portion 114 of each adjustment valve 111 has a tool slot 115 adapted to receive a screwdriver blade (not shown).

A relatively flat retaining plate 121 made of a synthetic resin functions to prevent rotation of the two adjustment valves 1 and is shared by the two adjustment valves 111. The retaining plate 121 is provided with two retainer holes 122 which are formed with the same spacing as the two screw holes 108 of the carburetor main body 101. A plurality of annular projecting strips 123 are formed on a back surface of the retaining plate 121 such that the strips 123 surround the respective retainer holes 122. The retaining plate is laid against the outer surface 102 of the carburetor main body 101. A gasket 125 is adapted to be clamped between the outer surface 102 and the retaining plate 121. The gasket 125 has two through-holes 126 which are formed with the same spacing as the screw holes 108, but which each have a larger diameter than the screw holes 108.

Each threaded rod 113 is provided with a small-diameter portion 113*b* adjacent the needle valve body 112, and a base-end portion 113*a* adjacent the head portion 114. The small-diameter portion 113*b* has an external diameter that is smaller than that of the base-end portion 113*a*. The small-diameter portion 113*b* of each threaded rod 113 has a length that is approximately 2 to 4 times the thickness of the retaining plate 121, and is formed so that it is longer than the combined thickness of the retaining plate 121 and gasket 125 in the embodiment illustrated in FIGS. 8 through 10.

Turning now to FIG. 9, the dimensional relationships of the threaded rods 113, retainer holes 122 and screw holes 8 are illustrated. The male threads 116*a* on the base-end portion 113*a* of each threaded rod 113 and the male threads 116*b* on the small-diameter portion 113*b* of each threaded rod 113 have the same pitch $P_1$, and also have the same thread-bottom diameter $d_1$ and effective diameter $d_2$. The external diameter $d_4$ of the small-diameter portion 113*b* is smaller than the external diameter $d_3$ of the base-end portion 113*a*, and is roughly equal to the effective diameter $d_2$. The female threads 109 of the screw hole 108 are formed so that they have a pitch $P_2$, thread-bottom diameter $D_1$, effective diameter $D_2$ and thread diameter $D_3$ matching those of the male threads 116*a* on the base-end portion 113*a*. The diameter $D_0$ of the retainer hole 122 is slightly smaller than the external diameter $d_3$ of the male threads 116*a* on the base-end portion 113*a* of each threaded rod 113.

To assemble the embodiment described above, the gasket 125 and retaining plate 121 are aligned by visual inspection so that the through-holes 126 and retainer holes 122 are more or less concentric with the carburetor screw holes 108. The gasket 125 and retaining plate 121 are then laid against the outer surface 102, and one of the adjustment valves 111 is inserted into one of the screw holes 108 while passing through one of the retainer holes 122. The needle valve body 112 and small-diameter portion 113*b* of the adjustment valve 111 pass unobstructed through the retainer hole 122 and through-hole 126, so that the needle valve body 112 is inserted into the screw hole 108. The male threads 116*b* on the small-diameter portion 113*b* then engage with the female threads 109 in the screw hole 108.

When the adjustment valve 111 has been screwed in a small amount so that the adjustment valve 111 is stably maintained on the same axial line as the corresponding screw hole 108, the male threads 116*a* on the base-end portion 113*a* reach the retainer hole 122 and, since the external diameter $d_3$ of the male threads 116*a* on the base-end portion 116*a* is slightly larger than the diameter of the retainer hole 122, the male threads 116*a* bite into the sides of the retainer hole 122. The male threads 116*a* therefore pass through the retainer hole 122 while cutting threads in a straight line of advance with no side-to-side inclination. When the valve body 112 has been inserted a prescribed amount into one of the jets 105 or 107, the screwing-in action is completed. By this procedure, not only does the biting of the threaded rod 113 into the retainer hole 122 facilitate assembly by eliminating side-to-side play of the adjustment valve 111, but the threaded rod 113 passes through the retaining plate 121 without damaging the thread-cut portion of the retainer hole 122 so that there is no loss of the rotation-stopping function of the retaining plate 121.

The other adjustment valve 111 is similarly passed through the other retainer hole 122 and screwed into the other screw hole 108, so that both adjustment valves 111 are set in positions which provide a prescribed air/fuel ratio, thus resulting in the assembled form shown in FIG. 10.

Because two adjustment valves 111 pass through and engage a single retaining plate 121, any tendency of one of the adjustment valves 111 to rotate as a result of vibration is checked because the rotation of the retaining plate 121 is prevented by the other adjustment valve 111. Thus, each adjustment valve 111 provides a rotation-stopping force to the other adjustment valve 111.

Furthermore, in the present embodiment, the annular projecting strips 123 on the retaining plate 121 are pressed against the gasket 125 in order to prevent the air/fuel ratio from being thrown out of adjustment by air passing through the minute gaps between the male threads of the threaded rods 113 and the female threads 109 of the screw holes 108. However, those skilled in the art will recognize that similar results could be achieved by providing a flat-plate-form retaining plate 121 having no annular projecting strips 123 that is simply laid directly against the outer surface 102 of the carburetor.

In the present embodiment, a rotation-stopping function is achieved through use of a single retaining plate 121 and two adjustment valves 111. However, in the situation where a carburetor has only a single adjustment valve 111, it would also be possible to obtain a rotation-stopping function by, for example, using an L-shaped retaining plate 121 with a portion that is laid against an outer surface 103 of the carburetor main body 101 that is perpendicular to the outer surface 102 in which the screw hole 108 is located.

The threaded rods 113 of the adjustment valves 111 may be manufactured by first providing a threaded rod, and then cutting away the outer circumference of the threads on one portion of the threaded rod such that a small-diameter portion 113*b* is formed, or by beginning with a small-diameter threaded rod, and then forming a base-end portion 113*a* by thread rolling.

In addition, since no compression coil springs are used, the distance that the adjustment valve 111 protrudes from the carburetor main body 101 can be reduced, and the head portions 114 of the adjustment valves 111 can also be reduced in size or eliminated. The rotational moment generated by vibration can thereby be reduced. Furthermore, the same effects as those obtained in a conventional device using a retaining plate 121, i.e., elimination of return immediately following adjustment and elimination of mutual interference, are also obtained.

Accordingly, a fuel adjusting device is described in which the threaded rods 113 of the adjustment valves 111 pass through retainer holes 122 in a retaining plate 121 while cutting threads in the edges of the holes, and are then screwed into screw holes 108 formed in the main body of a carburetor so that the retaining plate 121 is used to prevent rotation of the adjustment valves 111. Small-diameter portions 113*b* are provided on the threaded rods 113 and are adapted to pass unobstructed through the retainer holes 122 in the retaining plate 121 to screw into the screw holes 108 in the carburetor main body 101. Advantageously, the threads of the threaded rods 113 will bite into the retaining plate 121, which has been aligned by visual inspection and laid against an outer surface 102 of the carburetor main body 101, in a stable manner without any side-to-side inclination of the threaded rods 113, so that the threaded rods 113 can pass through the retaining plate 121 without damaging the thread-cut portions of the retainer holes 122 in the retaining plate 121. As a result, an easy-to-assemble fuel adjusting device with a simple structure is achieved in which the retaining plate 121 is held tightly against the carburetor main body 101 and prevents rotation of the adjustment valves 111.

Figure 11:
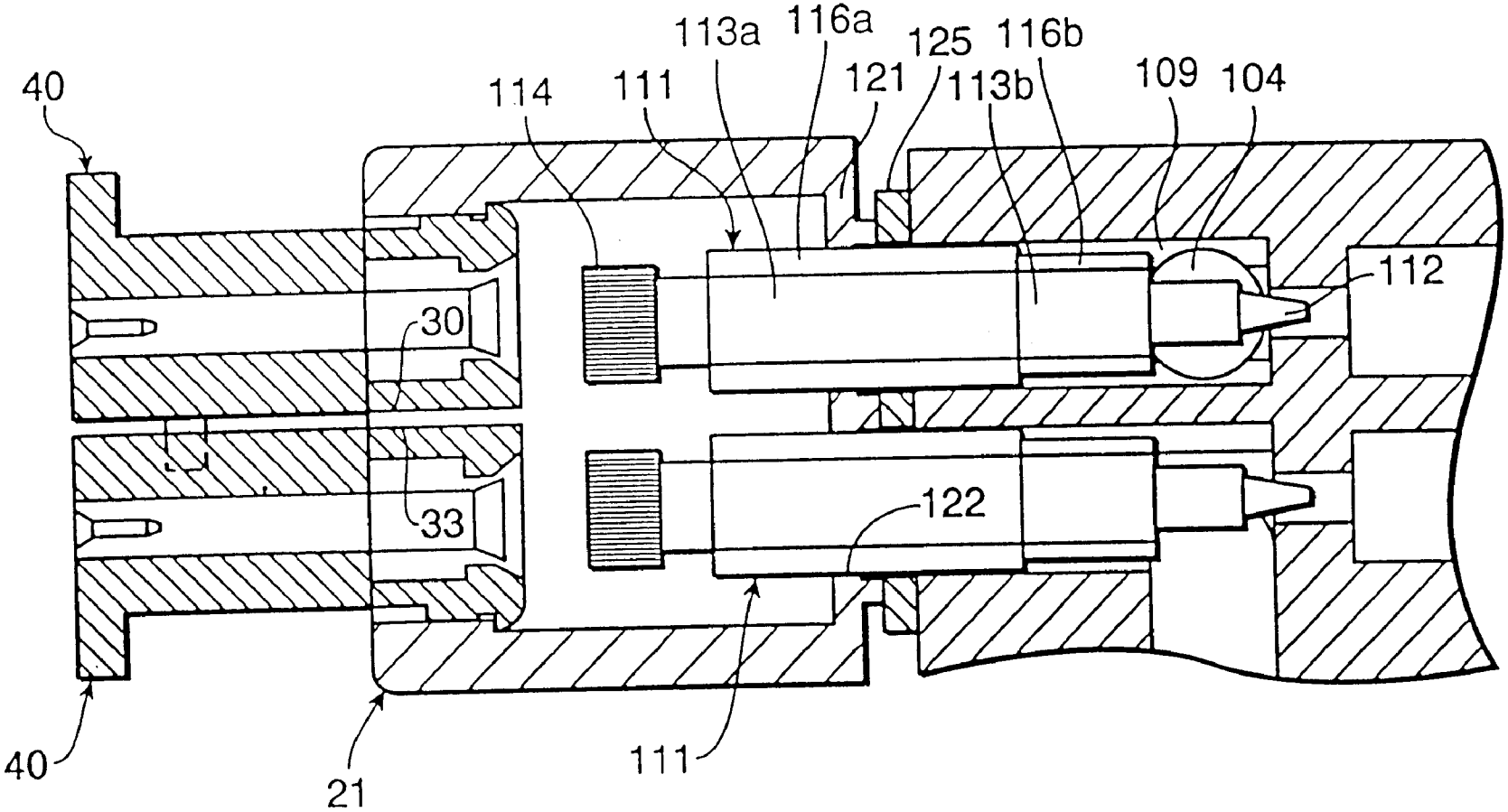
FIG. 11 is a cross-sectional view of another alternative embodiment of the present invention.

Turning now to FIG. 11, there is shown a fuel adjusting device that combines the retainer 21 described above with respect to FIGS. 1, 5, 6 and 7, with the retaining plate 121 described above with respect to FIGS. 8 through 10. In this embodiment, the retaining plate 121 is substituted for the contact wall 24 of the retainer 21 to provide a fuel adjusting device comprising a pair of caps 40 pressed into two retention holes 30 and 33 in the retainer 21, substantially as described above in relation to the embodiment shown in FIGS. 1, 5, 6 and 7. The retaining plate 121 takes the place of the contact wall 24, and includes one or more retainer holes 122 adapted to receive and retain the adjustment valves 111, as described above in relation to the embodiment shown in FIGS. 8 through 10. By substituting the retaining plate 121 for the contact wall 24 as shown in FIG. 11, the fuel adjusting device achieves all of the advantages described above.

While the above description contains many specificities, these should not be construed as limitations on the scope of the invention, but rather as an exemplification of preferred embodiments thereof. Other variations are possible.

Accordingly, the scope of the present invention should be determined not by the embodiments illustrated above, but by the appended claims and their legal equivalents.

What is claimed is:

1. A fuel adjustment device for a carburetor comprising a carburetor body, a manual adjustment valve adjustably inserted into said carburetor body and having an extension extending beyond said body, a cap engaging the end of said extension of said adjustment valve in an engaged position, and a retainer attached to said carburetor body and having a retention hole therein adapted to receive and retain said cap in a disengaged position adjacent said extension of said adjustment valve in all orientations of said carburetor body and said retainer.

2. The fuel adjustment device of claim 1 wherein said cap is capable of moving in unison with said valve while in the engaged position.

3. The fuel adjustment device of claim 1, wherein said retainer is disposed over said extension of said adjustment valve.

4. The fuel adjustment device of claim 1, wherein said retention hole comprises a cylindrical cut-out having a smaller cross-sectional area than said cap.

5. The fuel adjustment device of claim 1, wherein said cap further comprises an insertion hole therethrough for a tool to pass to make adjustments to said adjustment valve.

6. The fuel adjustment device of claim 5, wherein said insertion hole further comprises an engagement area adjacent said extension of said adjustment valve enabling said cap to engage said extension of said adjustment valve and move in unison with said adjustment valve.

7. The fuel adjustment device of claim 6, wherein said engagement area further comprises a protrusion to prevent said cap from slipping from an engaged position on said extension of said adjustment valve.

8. The fuel adjustment device of claim 1, further comprising a recess in one of said cap and said retention hole of said retainer, and a protrusion on the other one of said cap and in said retention hole of said retainer, said recess and protrusion being constructed and arranged to prevent rotation of said cap when said cap is received and retained in said retention hole in the disengaged position.

9. The fuel adjustment device of claim 1, wherein said manual adjustment valve further comprises a base-end portion and a small-diameter portion.

10. The fuel adjustment device of claim 9, wherein said retainer further comprises a retaining plate having a retainer hole adapted to receive and retain said adjustment valve in a prescribed adjustment position, and wherein the retainer hole of said retaining plate has a diameter larger than the external diameter of the small-diameter portion of said adjustment valve and smaller than the external diameter of the base-end portion of said adjustment valve.

11. A fuel adjustment limiting device for a carburetor having a body and an adjustment valve adjustably inserted in the body, comprising a cap adapted to mount the adjustment valve in an engaged position, and a retainer adapted to attach to the body of the carburetor, said retainer having a retention hole therein adapted to receive and retain said cap in a disengaged position adjacent the adjustment valve in all orientations of said retainer.

* * * * *

UNITED STATES PATENT AND TRADEMARK OFFICE

CERTIFICATE OF CORRECTION

| | | |
|---|---|---|
| PATENT NO | : | 5,955,007 |
| DATED | : | September 21, 1999 |
| INVENTOR(S) | : | KIMIO KOIZUMI et al. |

It is certified that error appears in the above-identified patent and that said Letters Patent are hereby corrected as shown below:

Column 10, line 53, please change "valves 1" to -- valves 111 --.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*